US007275888B1

(12) United States Patent
Christensen et al.

(10) Patent No.: US 7,275,888 B1
(45) Date of Patent: Oct. 2, 2007

(54) INTERLOCKING BARRIERS

(75) Inventors: Marc E. Christensen, Salt Lake City, UT (US); Eric M. Simon, Salt Lake City, UT (US); William L. Snook, West Chester, PA (US)

(73) Assignee: Off the Wall Products, LLC, Salt Lake City, UT (US)

( * ) Notice: Subject to any disclaimer, the term of this patent is extended or adjusted under 35 U.S.C. 154(b) by 0 days.

(21) Appl. No.: 11/333,887

(22) Filed: Jan. 18, 2006

Related U.S. Application Data

(60) Provisional application No. 60/663,090, filed on Mar. 18, 2005.

(51) Int. Cl.

| | |
|---|---|
| ***E01F 9/00*** | (2006.01) |
| ***E01F 13/00*** | (2006.01) |
| ***E01F 13/02*** | (2006.01) |
| ***E01F 9/016*** | (2006.01) |
| *E01F 15/02* | (2006.01) |
| *E01F 15/10* | (2006.01) |

(52) U.S. Cl. ..... 404/6

(58) Field of Classification Search ..... 404/6, 404/9; 256/13.1

See application file for complete search history.

(56) References Cited

U.S. PATENT DOCUMENTS

| | | | | |
|---|---|---|---|---|
| 2,146,113 A | * | 2/1939 | Erickson | 40/607.14 |
| 2,262,873 A | * | 11/1941 | Wise | 40/607.12 |
| 4,681,302 A | | 7/1987 | Thompson | |
| 4,772,155 A | * | 9/1988 | Dinitz | 404/7 |
| 4,773,629 A | | 9/1988 | Yodock | |
| 4,869,617 A | | 9/1989 | Chiodo | |
| 5,011,325 A | | 4/1991 | Antonioli | |
| 5,123,773 A | | 6/1992 | Yodock | |
| 5,197,601 A | * | 3/1993 | Sterett | 206/511 |
| 5,208,585 A | * | 5/1993 | Sprague | 340/908.1 |
| 5,387,049 A | * | 2/1995 | Duckett | 404/6 |
| 5,452,963 A | | 9/1995 | Christensen | |
| 5,498,101 A | | 3/1996 | Braverman | |
| 5,531,540 A | | 7/1996 | Wasserstrom et al. | |

(Continued)

FOREIGN PATENT DOCUMENTS

AU B-50241/93 11/1995

(Continued)

OTHER PUBLICATIONS

Dexterity Design, MB-2 Modifications for Light Receiver, 2 pages, Dec. 2001.

*Primary Examiner*—Raymond Addie
(74) *Attorney, Agent, or Firm*—Workman Nydegger

(57) ABSTRACT

A stackable interlocking barrier system includes a first barrier having a front wall and a back wall each extending between a top wall and a floor, at least a portion of the front wall being sloped relative to the back wall. A second barrier also has a front wall and a back wall each extending between a top wall and a floor, at least a portion of the front wall being sloped relative to the back wall. The second barrier is inverted relative to the first barrier with the front wall of the second barrier seated against the front wall of the first barrier. A first connector is removably mounted on the first barrier and the second barrier so as to secure the first barrier to the second barrier.

21 Claims, 8 Drawing Sheets

U.S. PATENT DOCUMENTS

| | | | | |
|---|---|---|---|---|
| 5,605,413 | A | 2/1997 | Brown | |
| 5,611,641 | A | 3/1997 | Christensen | |
| 5,639,179 | A | 6/1997 | Jensen | |
| D400,264 | S | 10/1998 | Striefel et al. | |
| 5,836,714 | A | 11/1998 | Christensen | |
| 5,882,140 | A | 3/1999 | Yodock, Jr. et al. | |
| 5,988,934 | A | 11/1999 | Wasserstrom | |
| 6,059,491 | A | 5/2000 | Striefel et al. | |
| 6,086,285 | A | 7/2000 | Christensen | |
| 6,164,865 | A * | 12/2000 | McCallum | 404/6 |
| 6,199,833 | B1 * | 3/2001 | Bilby et al. | 256/24 |
| 6,233,898 | B1 * | 5/2001 | Burlando | 52/736.3 |
| D462,126 | S | 8/2002 | Englund | |
| 6,666,616 | B2 | 12/2003 | Yodock, III et al. | |
| 6,672,799 | B2 | 1/2004 | Earl | |
| 6,843,614 | B2 | 1/2005 | Yodock, Jr. et al. | |
| 6,863,468 | B2 * | 3/2005 | Davis et al. | 404/6 |

FOREIGN PATENT DOCUMENTS

| | | | |
|---|---|---|---|
| EP | 0 407 277 | A2 | 1/1991 |
| EP | 0 442 249 | A1 | 8/1991 |
| EP | 0 550 362 | A1 | 7/1993 |
| GB | 2 219 332 | A | 12/1989 |
| GB | 2 237 832 | A | 5/1991 |

* cited by examiner

INTERLOCKING BARRIERS

CROSS-REFERENCE TO RELATED APPLICATIONS

This application claims benefit to U.S. Provisional Patent Application Ser. No. 60/663,090, filed on Mar. 18, 2005, which for purposes of disclosure is incorporated herein by specific reference.

BACKGROUND OF THE INVENTION

1. The Field of the Invention

The present invention relates to barriers, and more particularly, portable, reusable, control barrier systems for use in controlling pedestrian and automobile traffic.

2. The Relevant Technology

Control barriers are used in a variety of situations. For example, control barriers can be selectively positioned at special events or construction sites to help direct pedestrian and automobile traffic in a desired direction. Alternatively, control barriers can be put up to help limit access to select areas. In yet other embodiments, control barriers can be put up to define an entertainment stage or the boundaries of a playing field. For example, control barriers can be used to define the boundaries of a soccer field or an ice skating rink.

Conventional control barriers have long comprised individual sawhorse type barriers or collapsible V-shape barricades. Such barriers, however, have limited use since they are generally lightweight and are thus easily tipped over or moved. This can be a problem when large crowds are encountered or when the barriers are being used on a playing field where they might get bumped. Furthermore, such barriers are typically not connected and often have spaces or gaps extending therethrough. As such, it is possible for individuals to either slip between or through the barriers.

Other barriers comprise various gates or walls which are constructed. Such barriers, however, require extensive time to assemble and disassemble. In yet other alternative embodiments, concrete barriers have been used. Although concrete barriers are not easily tipped over, such barriers are extremely heavy. As such, they are difficult to move and place in desired locations. Often, special equipment such as fork lifts or cranes are required. Furthermore, concrete barriers can be both difficult and expensive to move over large distances and require a large area to store. Concrete barriers can also be dangerous in that they are rigid and non-forgiving when impacted by a person.

In one attempt to overcome some of the above problems, plastic barriers have been made. The plastic barriers are hollow and can be filled with water for stabilizing. Although an improvement, existing plastic barriers also have several limitations. For example, plastic barriers are typically large and bulky. As a result, they are not easily stacked and require large areas to store and transport.

Often it is desirable for displays to be mounted onto the control barriers. Current barrier designs allow only a limited type of display to be used. Typically, the only type of display that can be used is one that can be mounted directly to the face of the barrier. Because of the size of current barriers, this amounts to a display at about ground level. While this may be sufficient in some situations, more flexibility may be desired in others.

When using barricades for traffic control, often it is desired to use many different types of displays at different heights. For instance, a sign on a rigid pole, such as a stop or yield sign may be desired that is eight or more feet above the ground so that it can be seen by motorists. Other types of desired displays may include reflective signs, flashing lights, etc. at lower heights. These disparate types of displays may even be desired to be mounted on the same barrier so they can be in the same relative location. Still other types of displays that are wider than current barriers may also be desired. Current barriers cannot accommodate all of these sign configurations concurrently.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
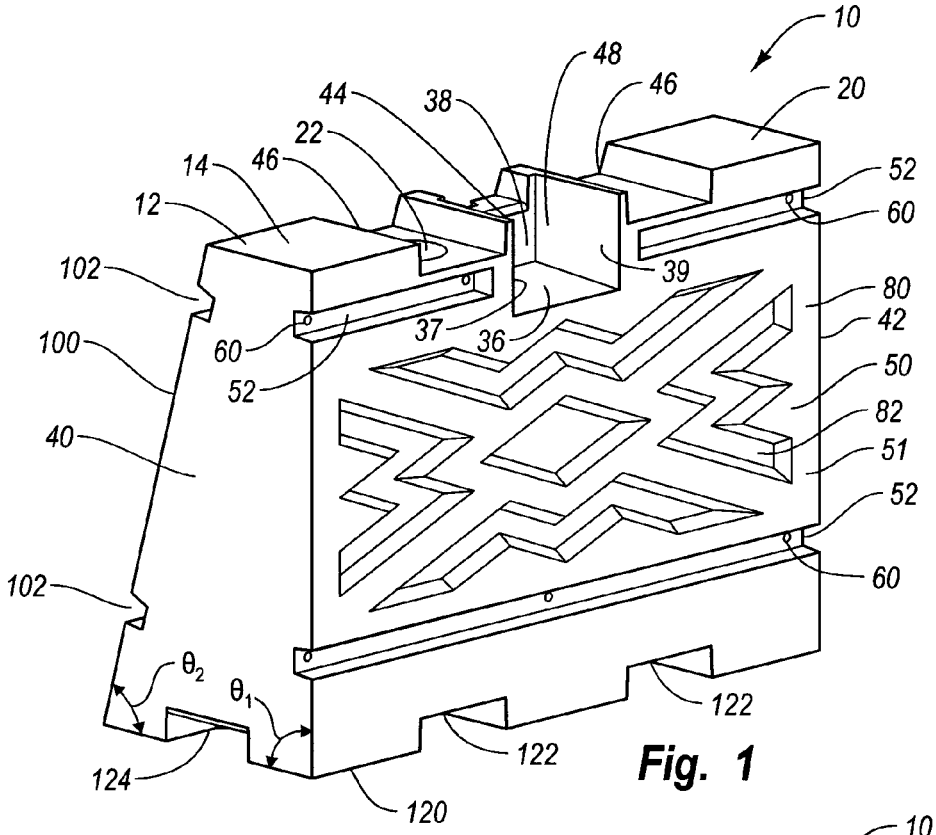
FIG. 1 is a front perspective view of one embodiment of a barrier of the present invention.
Figure 2:
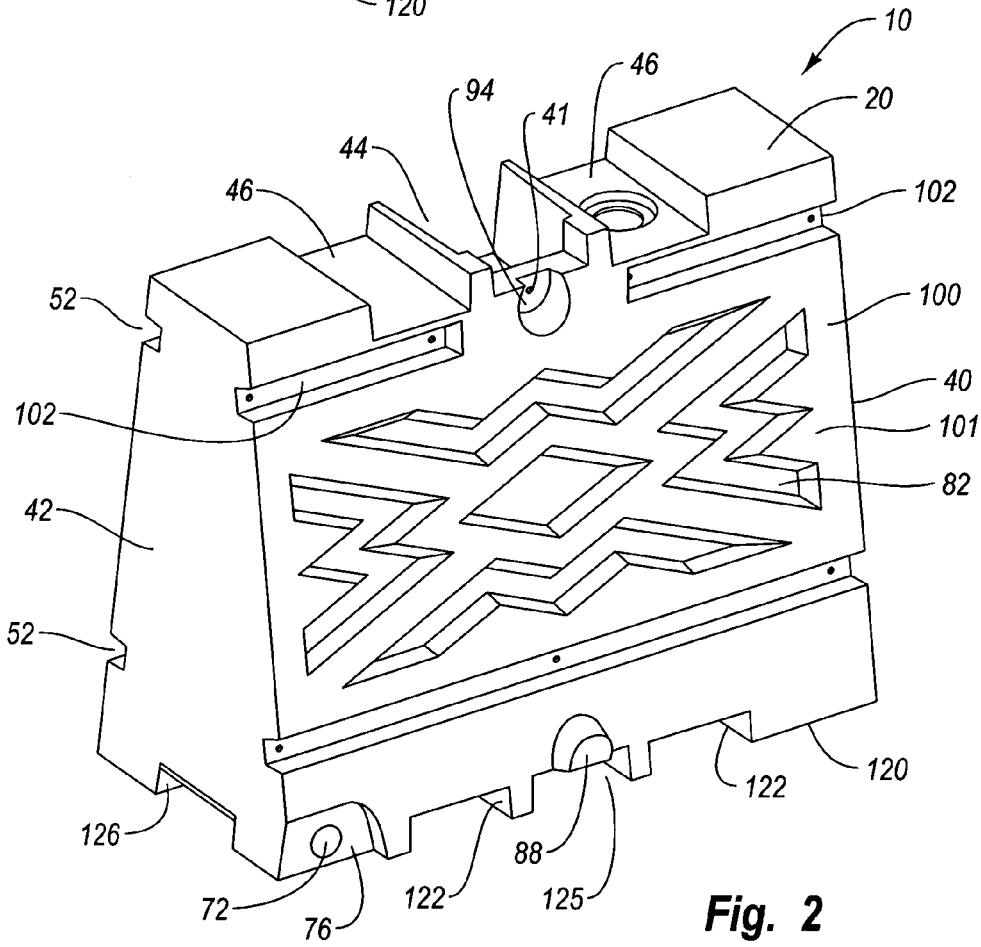
FIG. 2 is a back perspective view of the barrier shown in FIG. 1.

Depicted in FIGS. 1 and 2 is one embodiment of an inventive barrier 10 incorporating features of the present invention. Barrier 10 comprises a housing 12 having an exterior surface 14. Housing 12 structurally includes a front wall 50 having a front face 51 and an opposing back wall 100 having a back face 101. Front wall 50 and back wall 100 each extend between opposing sidewalls 40 and 42 and each extend between a top wall 20 and an opposing floor 120. Each of sidewalls 40 and 42 likewise extend between top wall 20 and floor 120.

Front wall 50 and back wall 100 are depicted as being substantially rectangular. In alternative embodiments front wall 50 and back wall 100 can have alternative geometrical shapes such as a square or can be curved to form a corner. In the embodiment depicted, sidewalls 40 and 42 are substantially trapezoidal being wider at the bottom then at the top. As a result, front wall 50 and back wall 100 are closer to each other where front wall 50 and back wall 100 each intersect top wall 20 than where front wall 50 and back wall 100 each intersect floor 120. Specifically, front wall 50 intersects with floor 120 at an inside angle $\theta_1$ of about 90°. In alternative embodiments, angle $\theta_1$ can be in a range between about 60° to about 90° with about 80° to about 90° being more preferred. Other angles can also be used. Back wall 100 intersects with floor 120 at an angle $\theta_2$ in a range between about 60° to about 80° with about 70° to about 80° being more preferred and about 75° being most preferred. Other angles can also be used. Thus, in other embodiments front wall 50 and back wall 100 can be disposed in parallel planes, can each slope in intersecting planes, or one wall can be vertical while the other wall slopes relative thereto.

Figure 5:
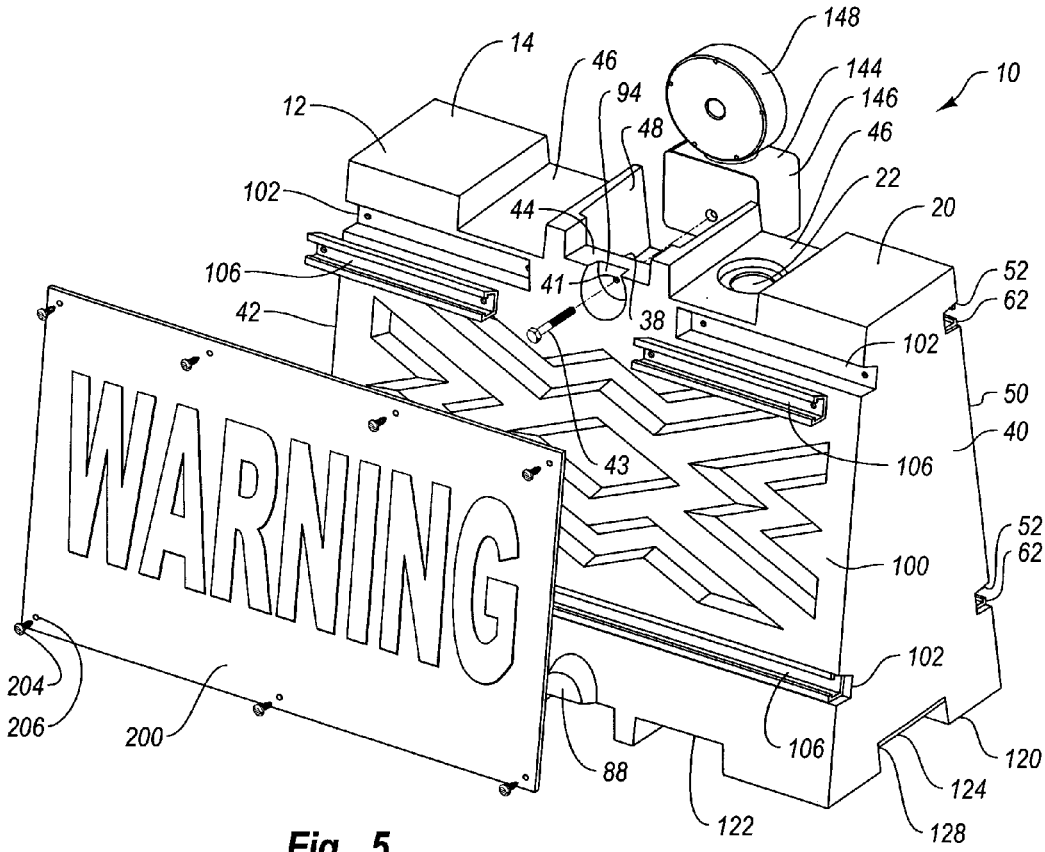
FIG. 5 is a partially exploded back perspective view of one embodiment of a barrier of the present invention with channels, a display, and a barrier light.

In some embodiments, a recess 48 is formed at an upper end of housing 12. Recess 48 is depicted centrally formed on top wall 20 and front wall 50 and is sized to accommodate a standard barrier light 144. As depicted in FIG. 5, barrier light 144 comprises a housing 146 in which a battery is disposed and a lens 148 in which a light filament is disposed. Barrier light 144 can have a variety of other configurations. Returning to FIGS. 1 and 2, recess 48 is bounded by a floor 36, opposing side walls 37 and 39, and a partition wall 38. Partition wall 38 is formed between recess 48 and back face 101 of back wall 100. A notch 44 is formed on a top surface of partition wall 38 and likewise extends between recess 48 and back face 101 of back wall 100. In one embodiment, recess 48 has a width extending between side walls 37 and 39 that is typically in a range between about 10 cm to about 30 cm, a height extending between floor 36 and the top surface of top wall 20 in a range between about 10 cm to about 30 cm, and a depth between about 10 cm to about 30 cm. Other dimensions can also be used.

In the embodiment shown, recess 48 extends through front wall 50. In alternative embodiments, it is appreciated that recess 48 can be formed as a pocket that is recessed only into top wall 20 but does not extend through front wall 50. Other configurations can also be used.

Light fixture 144 can be secured within recess 48 using any conventional methods such as screws, bolts, clips, Velcro or other known fastening methods. In the embodiment depicted, a hole 41 extends through partition wall 38. A bolt 43 having an enlarged head can be selectively passed through hole 41 so as to engage housing 46, thereby securing barrier light 144 with recess 48 (FIG. 5). Bolt 43 can also be replaced with other types of fasteners such as screws, pins, expansion bolts, and the like. This assembly provides protection for barrier light 144 which is partially sheltered within recess 48 while providing secure engagement with barrier 10. As will be discussed below in greater detail, notch 44 and partition wall 38 can also be configured to allow stacking and coupling of two barriers 10 using connectors.

Figure 3:
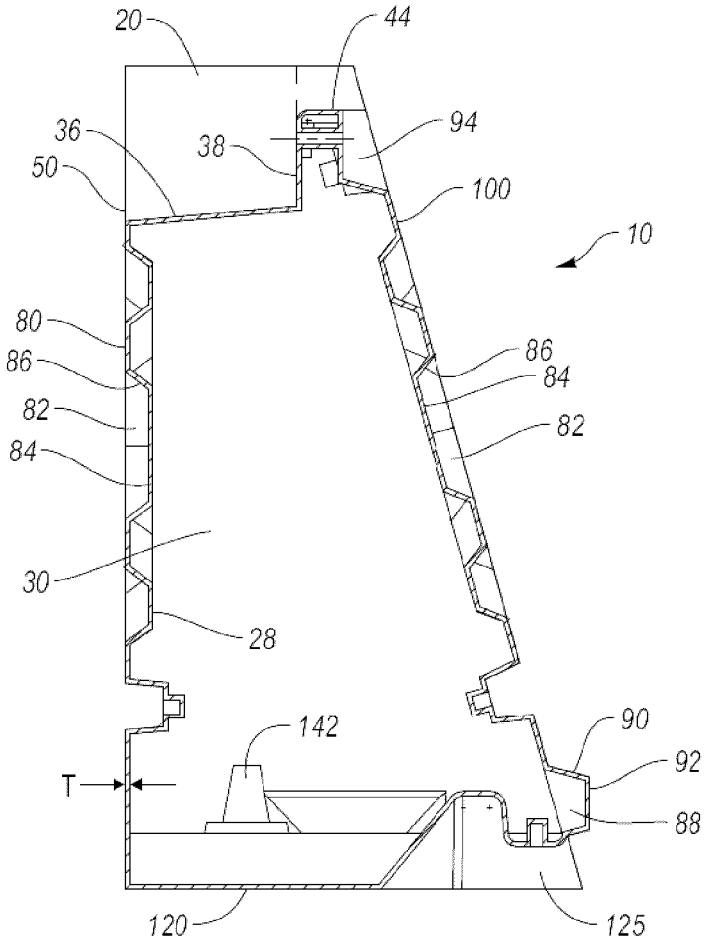
FIG. 3 is a cross-sectional side view of the barrier shown in FIG. 1.

As depicted in FIG. 3, barrier 10 also has an interior surface 28 that bounds an internal chamber 30. Internal chamber 30 is configured to receive a ballast. As used in the specification and appended claims, the term "ballast" is broadly intended to include any materials which can be poured into internal chamber 30. By way of example and not by limitation, the ballast can include water, salt water, non-freezing fluids, sand, rock, cement, concrete, and the like.

In one embodiment of the present invention, means are provided for filling internal chamber 30 with ballast. By way of example and not by limitation, as depicted in FIG. 5, internal chamber 30 communicates with the exterior through an opening 22 located on top wall 20. Opening 22 can be selectively closed or sealed by a cap (not shown). In alternative embodiments, opening 22 can be positioned at other locations on barrier 10. Means are also provided for selectively draining ballast from barrier 10. By way of example and not by limitation, as depicted in FIG. 2, a threaded drain hole 72 extends through back wall 100 adjacent floor 120. A Plug (not shown) can be screwed into or otherwise attached to drain hole 72 for sealing drain hole 72 closed. In alternative embodiments, drain hole 72 can also be positioned at other locations on barrier 10. To help prevent the plug from accidentally being knocked out of drain hole 72, drain hole 72 is preferably positioned within a recess 76 formed on back wall 100.

Returning to FIG. 3, upwardly projecting from floor 120 of barrier 10 is a substantially conical post 142. Post 142 is vertically aligned with opening 22 on the top wall 20 of barrier 10 (FIG. 5). Post 142 is configured to be received in the end of a hollow pole such as a flag pole, support pole, or any other type of pole. As a result of post 142 being substantially conical, post 142 can be snugly received within a variety of alternative pole sizes. In alternative embodiments, post 142 can be different configurations to receive different pole configurations. Further details concerning possible pole configurations that can be used with the present invention are given in U.S. Pat. No. 6,086,285, which is incorporated herein by reference (hereinafter "the '285 patent").

Barrier 10 can be configured such that when internal chamber 30 is absent a ballast, sidewalls 40 and 42 are substantially planar or bow inwardly. Barrier 10 can also be configured such that as internal chamber 30 is filled with a ballast, sidewalls 40 and 42 bow outwardly. As will be discussed below in greater detail, the bowing of sidewalls 40 and 42 can be used to help interlock adjacent barriers. Of course, the extent which sidewalls 40 and 42 can bow outwardly depends in part on the weight and amount of ballast that is positioned within barrier 10.

If desired, to help maximize the bowing of sidewalls 40 and 42 as barrier 10 is filled with ballast, sidewalls 40 and 42 can be formed substantially flat and uniform. In this configuration, the rigidity of sidewalls 40 and 42 is minimized, thereby maximizing bowing. Further details concerning such bowing can be found in the '285 patent. In alternative embodiments, sidewalls 40 and 42 need not be designed to bow and can be formed with reinforcing structures that help limit bowing.

Barrier 10 can also be configured to prevent substantial bowing in one or more of the walls. In one embodiment of the present invention, means are provided for substantially preventing the bowing of front wall 50 and back wall 100 when internal chamber 30 is filled with a ballast. By preventing the bowing of front wall 50 and back wall 100, deformation to any displays mounted thereon is minimized. As depicted in FIGS. 1-3, by way of example and not by limitation, a plurality of pockets 82 are recessed within a top surface 80 of front wall 50 and back wall 100. Each of pocket 82 includes a floor 84 and a reinforcing wall 86 extending between top surface 80 and floor 84. In one embodiment, reinforcing wall 86 can be sloping. Reinforcing walls 86 provide structural integrity and stiffening to both front wall 50 and back wall 100 which substantially prevents bowing of these walls.

In alternative embodiments, it is appreciated that pockets 82 and the corresponding reinforcing walls 86 can have a variety of alternative geometrical configurations. For example, pockets 82 and reinforcing walls 86 can be circular, square, irregular, or other polygonal configuration. Pockets 82 can also be randomly or uniformly spaced over front wall 50 and back wall 100. In yet other embodiments, reinforcing walls 86 can smoothly transition into pocket floor 84. For example, pockets 82 can have a semi-spherical configuration. In yet other embodiments, pockets 82 can be replaced with reinforcing ribs or projections that outwardly project from top surface 80 of front wall 50 and back wall 100. Slots 52 and channels 62, discussed below, will also help to substantially prevent bowing of front wall 50 and back wall 100.

Barrier 10 is typically made of a resiliently deformable polymeric material having strong, semi-rigid, and energy absorbing properties. Such materials include linear or cross-linked plastics which will deform under pressure but will not fail in a brittle manner. Examples of conventional polymeric materials include polyethylene (including High Density Polyethelene [HDPE]), polyvinylchloride, nylon, polycarbonate, and polypropylene. Additives such as dyes, pigments, and reinforcements, such as fibers, can also be added to the material. Florescent dies can be added to help barriers 10 glow at night for better direction of traffic. In one embodiment, it is preferred that barrier 10 be made from a recyclable plastic such as polyethylene or HDPE. This enables old or broken barriers to be ground down and recycled into new barriers.

Barrier 10 is typically made by blow molding. Of course, other molding processes, such as rotational molding, injection molding or die molding, can also be used. Independent of the method used, it is generally desirable that barrier 10 have a substantially uniform thickness T, as shown in FIG. 3, so as to minimize shrink deformation. In one embodiment, barrier 10 has a thickness T in a range between about 0.2 cm to about 1.5 cm with about 0.3 cm to about 0.8 being more common. The thickness is chosen to optimize desired deflection and required strength properties. Other dimensions can also be used.

Figure 4:
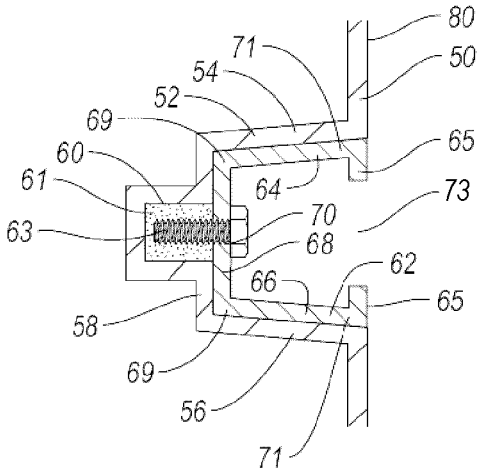
FIG. 4 is a cross-sectional side view of a slot and attached channel according to one embodiment of the present invention.

In one embodiment of the present invention, barrier 10 includes one or more slots 52 recessed on front wall 50. As depicted in FIG. 1, slots 52 are substantially horizontally disposed on top surface 80 of front wall 50. In alternative embodiments, slots 52 can be vertically disposed, diagonally disposed, or some combination of all three. Furthermore, slots 52 can be comprised of a single, elongated slot, or, as depicted in the embodiment of FIG. 1, multiple, spaced apart slots. As depicted in FIG. 4, each slot 52 includes a back wall 58, a top wall 54, and a bottom wall 56. The top and bottom walls 54, 56 each extend between top surface 80 and back wall 58 along the longitudinal length of slot 52.

A retention channel 62 can be securely fastened within each slot 52. As depicted in FIGS. 4 and 5, retention channel 62 has a substantially c-shaped transverse cross section formed by a back wall 68, a top wall 64, and a bottom wall 66. The top and bottom walls 64, 66 each attach to opposite sides of back wall 68 at a proximal end 69 of the top and bottom walls 64, 66 and extend out from back wall 68. Lips 65 extend toward each other from a distal end 71 of each of the top and bottom walls 64, 66 to complete the "c" cross-sectional shape. An elongated opening 73 is formed between lips 65. In alternative embodiments, retention channel 62 can be substantially square-shaped, flat, or any other suitable shape. Retention channel 62 can be made of polymeric material, metal, or other materials known in the art.

Retention channel 62 is securely attached to front wall 50 within slot 52 with top wall 64, back wall 68, and bottom wall 66 of channel 62 each biased against or disposed adjacent to top wall 54, back wall 58, and bottom wall 56 of slot 52, respectively. In this manner, opening 73 of the "c" formed by retention channel 62 is facing out and away from slot 52, and retention channel 62 is recessed within slot 52. Attachment can occur by using screws, bolts, adhesives, friction fit, Velcro or any other known attachment technique. Channels 62 can also be implanted during the molding of barrier 10.

In one embodiment depicted in FIG. 4, a plurality of spaced apart sockets 60 are formed within back wall 58 of slot 52. Sockets 60 are configured to receive a threaded insert 61 into which a screw or bolt can be screwed. Inserts 61 can be directly molded into barrier 10 or can be subsequently secured within sockets 60. Apertures 70 extend through back wall 68 of retention channel 62. Each aperture 70 is configured to align with a corresponding threaded insert 61 when retention channel 62 is received within a corresponding slot 52. As a result, a threaded bolt 63 can be passed through aperture 70 and screwed into threaded insert 61 to secure channel 62 within slot 52.

One or more slots 102 can be recessed within back wall 100 in a similar manner and orientation to that described above with regard to front wall 50. A retention channel 106 can be secured within each slot 102. Slots 102 and channels 106 are substantially identical to slots 52 and channels 62, respectively. Thus, identical structural elements between slots 52 and 102 and between channels 62 and 106 are identified by like reference characters.

Figure 6:
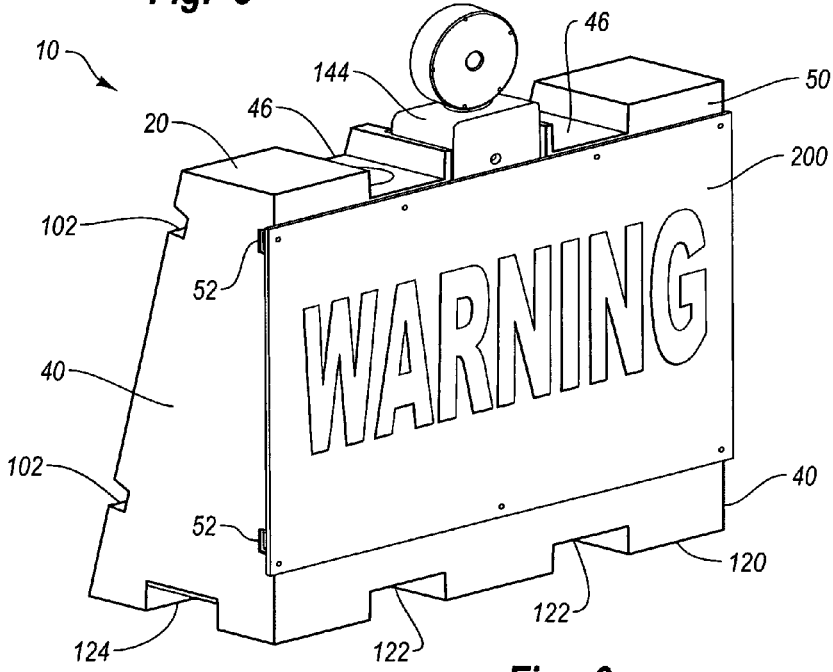
FIG. 6 is a perspective view of the barrier shown in FIG. 5 from a different angle with the display and light fixture attached.

Many types of displays can be mounted on barrier 10 using slots 52 and channels 62 located on front wall 50, and/or slots 102 and channels 106 located on back wall 100. For example, as depicted in FIGS. 5 and 6, a display 200 can be attached to barrier 10 on either back wall 100 or front wall 50. In FIG. 6, display 200 is mounted on front wall 50 using channels 62 which have been secured in slots 52. Although not required, it is preferred that channels 62 be sufficiently recessed within slots 52 such that when display 200 is attached to channels 62, display 200 is substantially flush against the top surface 80 of front wall 50. Depending on the intended use, it is appreciated that any number of different types, size and number of signs, sign posts, rails, panels, supports, guides reflectors, and the like can be mounted to barrier 10 using channels 62 and 106.

Figure 7:
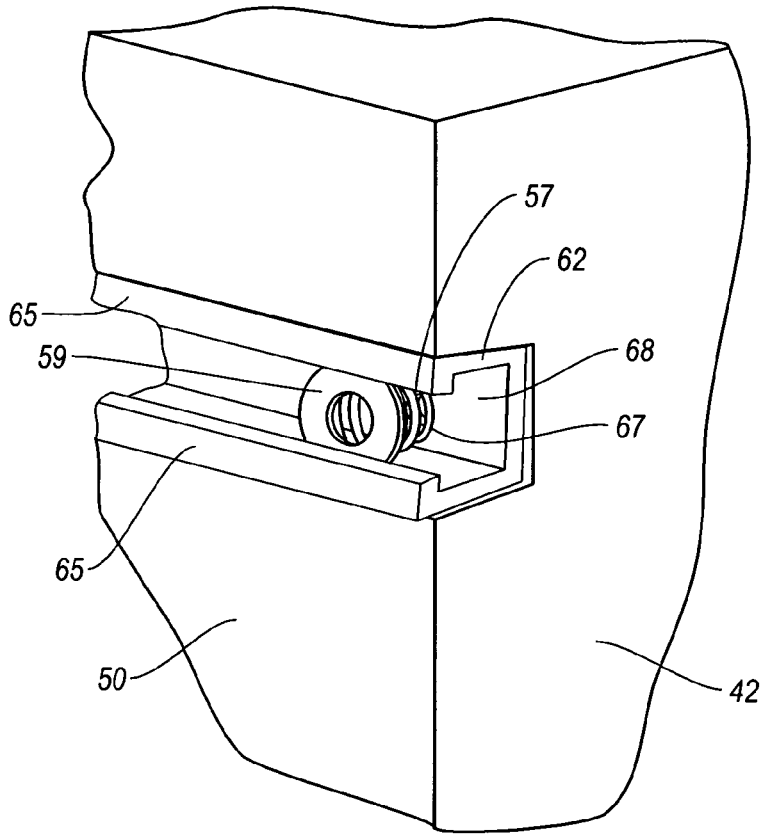
FIG. 7 is a perspective view of a slot, retention channel and spring-loaded nut according to one embodiment of the present invention.
Figure 8:
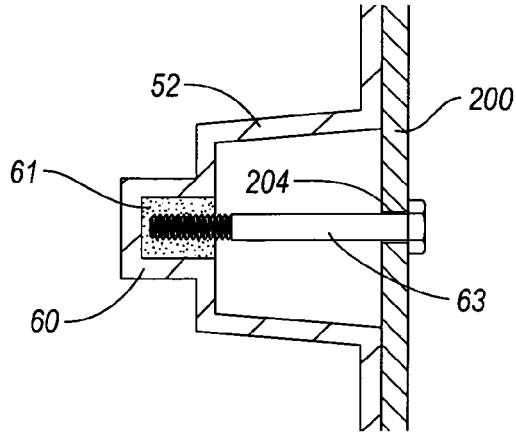
FIG. 8 is a cross-sectional side view of a slot and attached display according to one embodiment of the present invention.

As depicted in FIG. 7, a spring-loaded nut 67 comprises a spring 57 and a threaded nut 59 mounted thereon. Spring-loaded nut 67 can be inserted into channel 62 such that spring 57 biases threaded nut 59 against the lips 65 of channel 62. Spring 57 is thus used to selectively secure nut 59 at a desired location along channel 62. Spring-loaded nut 67 can be positioned longitudinally in channel 62 until the nut 67 aligns with an aperture 204 of display 200 (FIG. 5). Display 200 can then be secured to barrier 10 by passing bolts 206 through apertures 204 in display 200 which in turn threadedly engage with the spring-loaded nuts 67 within channels 62. Alternatively, as depicted in FIG. 8, display 200 can be secured to barrier 10 without using channels 62 by aligning each aperture 204 in display 200 with a threaded insert 61 of slot 52. A threaded bolt 63 is then passed through aperture 204 which in turn threadedly engages directly with threaded insert 61 in socket 60 of slot 52.

Figure 9:
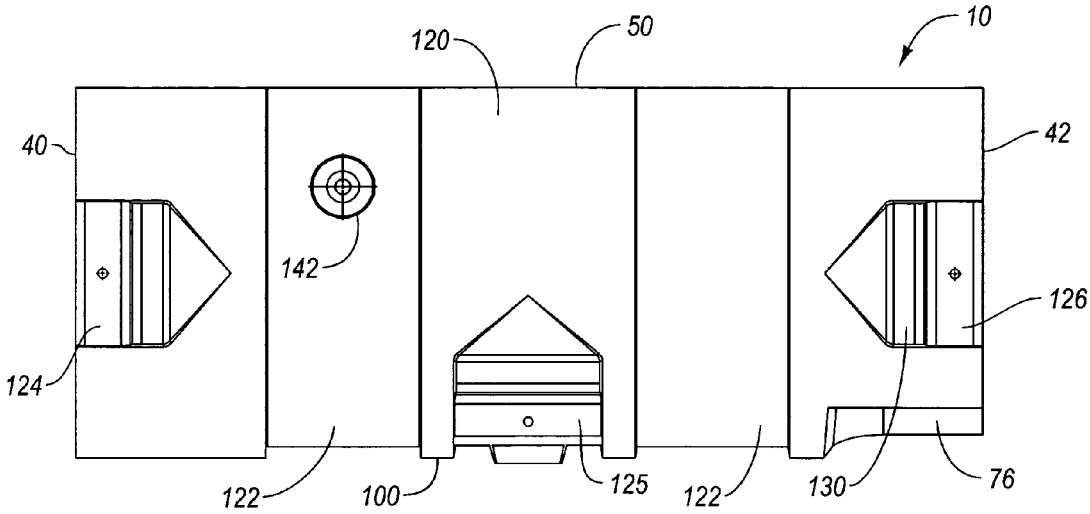
FIG. 9 is a bottom plan view of the barrier shown in FIG. 1.

Depicted in FIG. 9 is the exterior surface of floor 120 according to one embodiment. A pair of fork lift channels 122 are recessed on floor 120 and extend from front wall 50 to back wall 100. Fork lift channels 122 are configured to receive the tines of a fork lift such that, if desired, barrier 10 can be moved by a fork lift even if filled with ballast. Means can also be provided for increasing the coefficient of friction of barrier 10 by securing pads or other similar devices to floor 120 as described in the '285 patent.

In one embodiment of the present invention, means are provided for connecting together a pair of discrete barriers 10 such that the strength of the connection therebetween increases as the pair of barriers 10 are filled with ballast. By way of example and not by limitation, slots 124 and 126 are recessed on floor 120 adjacent to sidewalls 40 and 42, respectively. Depicted in FIGS. 9 and 10, slot 126 comprises a horizontal portion 128 that extends through sidewall 42 and intersects with a vertical portion 130. Vertical portion 130 projects into floor 120 towards top wall 20. Vertical portion 130 is in part bounded by a curved and outwardly sloping inside wall 132, a roof 134, and an outside wall 136. Extending between outside wall 136 and sidewall 42 is a platform 138. A hollow socket 140 upwardly extends from platform 138. Securely received within hollow socket 140 is a threaded insert 162.

Recessed within floor 120 adjacent to sidewall 40 is slot 124. Slot 124 is substantially identical to slot 126. In some embodiments, as depicted in FIGS. 2, 3, and 9, recessed within floor 120 adjacent to back wall 100 is a slot 125, which is also substantially identical to slots 124 and 126. Thus, identical structural elements between slots 124, 125, and 126 are identified by like reference characters.

Figure 11:
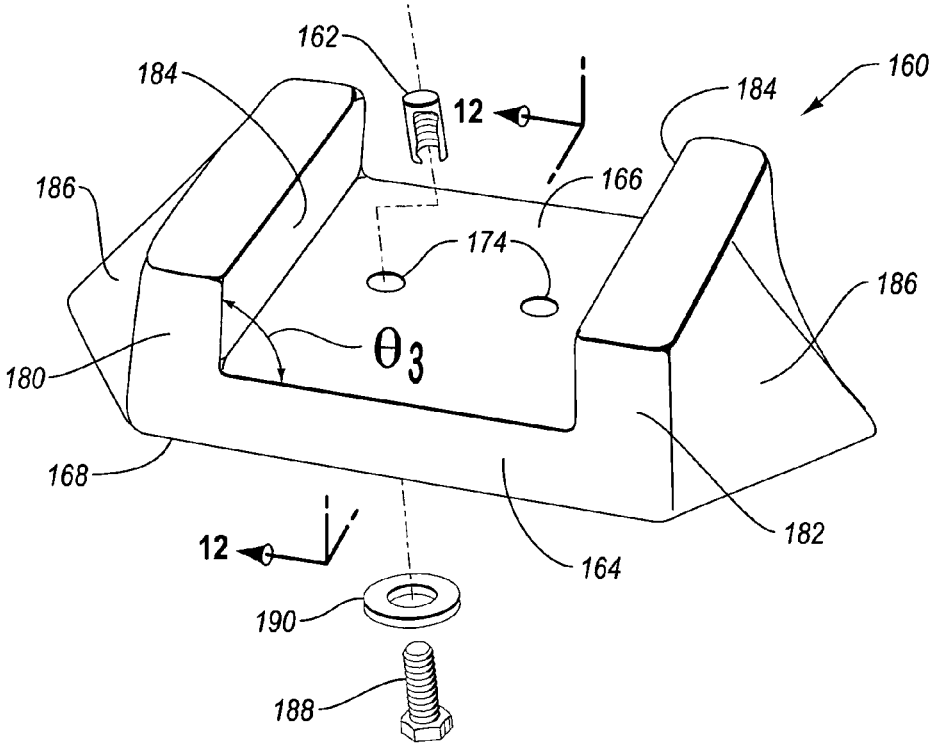
FIG. 11 is an exploded perspective view of the connector shown in FIG. 10.

Slots 124, 125, and 126 are configured to receive a corresponding connector 160. As depicted in FIG. 11, connector 160 is substantially U-shaped and includes a cross-member 164 having legs 180 and 182 upstanding from opposing ends thereof. Connector 160 is preferably made from the same materials and in the same process as barrier 10. Each of legs 180 and 182 has an inside face 184 and an opposing outside face 186. Inside face 184 preferably forms an angle $\theta_3$ relative to a top surface 166 of cross-member 164 less than 90°. More preferably, angle $\theta_3$ is in a range between about 75° to about 85°. Other angles can also be used. For example, angle $\theta_3$ can be 90° or greater. Outside face 186 has a substantially conical configuration complementary to inside wall 132 of slots 124, 125, and 126. In alternative embodiments, outside face 186 can be flat, such as similar to inside face 184.

Figure 10:
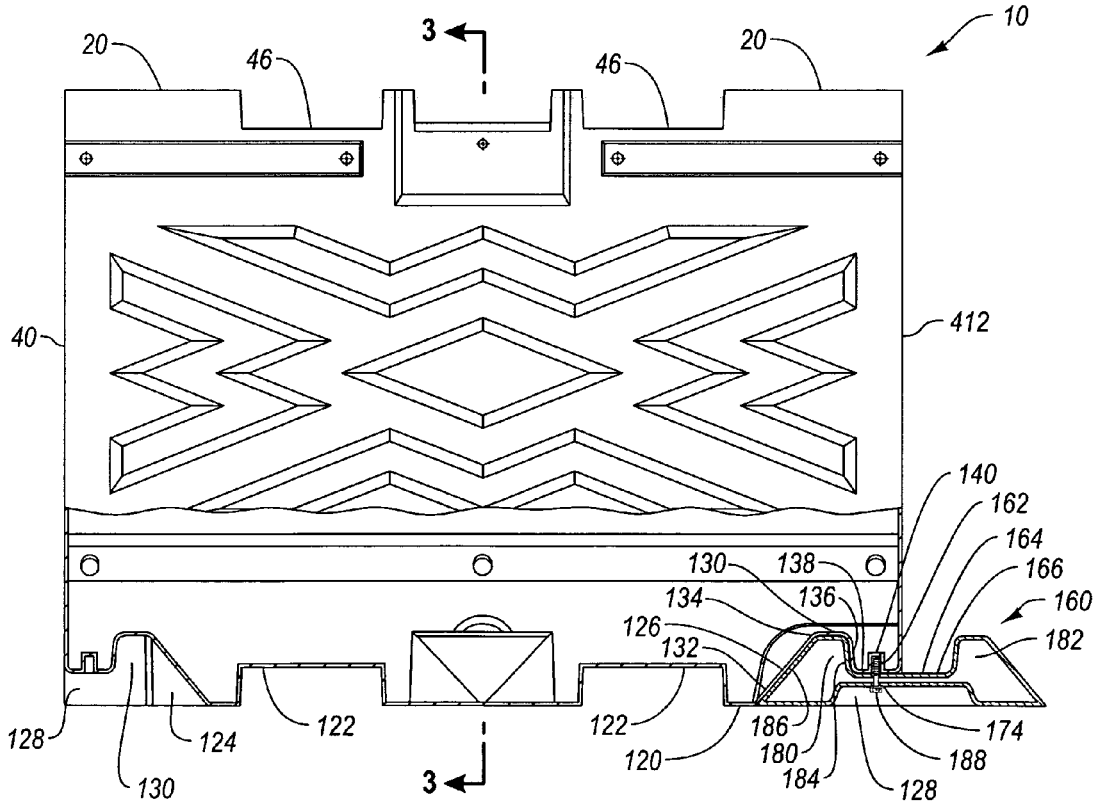
FIG. 10 is a partially cut away front view of the barrier shown in FIG. 1 including an attached connector.
Figure 12:
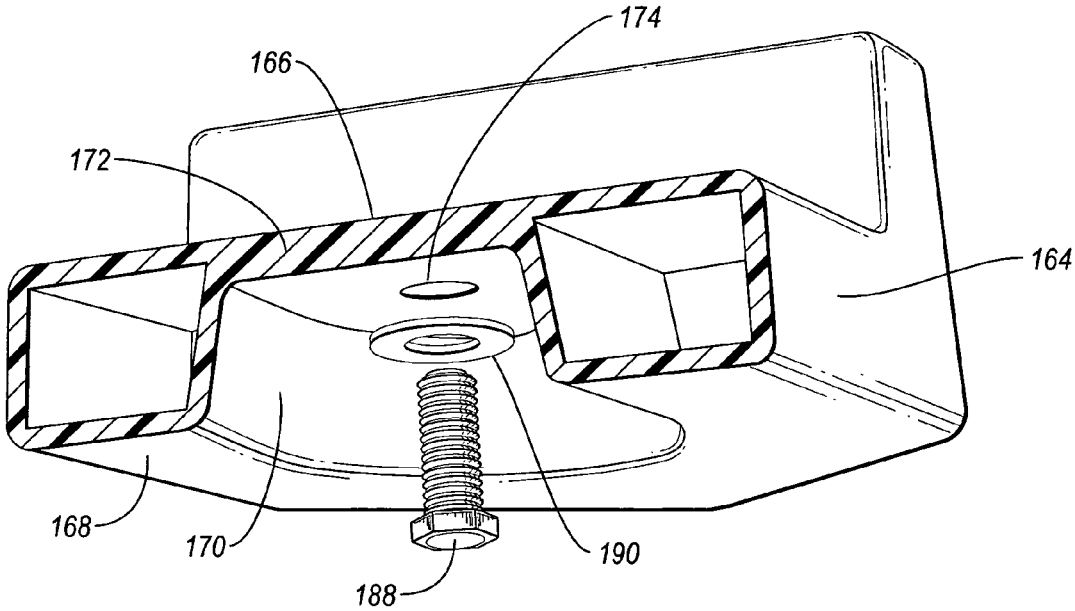
FIG. 12 is a cross-sectional perspective view of the connector shown in FIG. 11.

Depicted in FIG. 12, cross member 164 has a bottom surface 168 with a recess 170 formed therein. Extending between recess 170 and the top surface 166 of cross member 164 is a solid plate portion 172. As depicted in FIGS. 11 and 12, a pair of spaced apart apertures 174 extend through plate portion 172. Each aperture 174 is configured to align with a corresponding threaded insert 162 when each leg 180 or 182 is received within a corresponding slot 124, 125, or 126. As a result, a threaded bolt 188 having a washer 190 mounted thereon can be passed through aperture 174 and screwed into threaded insert 162 for securing connector 160 to barrier 10, as shown in FIG. 10.

Figure 13:
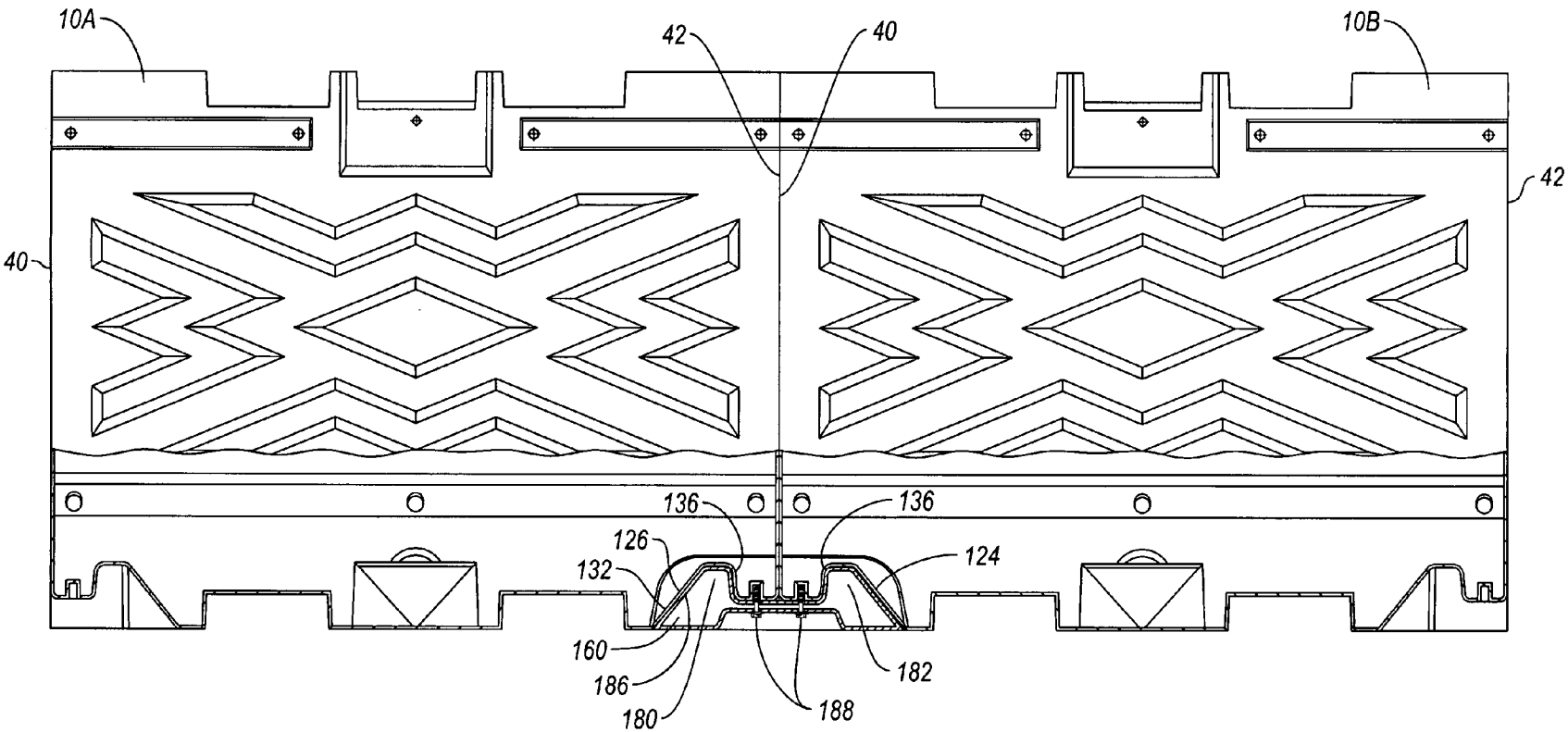
FIG. 13 is a partially cut away front view of a pair of barriers shown in FIG. 1 attached by the connector shown in FIG. 11.

As depicted in FIG. 13, when it is desirable to attach a pair of barriers 10 together, leg 180 of connector 160 is received within slot 126 of a first barrier 10A. Inside wall 132 of slot 126 of barrier 10A and outside face 186 of connector 160 are complementarily configured as previously discussed so that leg 180 is self seating within slot 126. A bolt 188 can then be used to mechanically secure connector 160 to barrier 10A. It is noted that bolts 188 are often not required since the weight of barrier 10 having a ballast is usually sufficient to keep barrier 10 attached to connector 160.

Sidewall 40 of a second barrier 10B is then biased against sidewall 42 of first barrier 10A so that leg 182 of connector 160 is received within slot 124 of second barrier 10B. If desired, another bolt 188 can then be used to mechanically secure connector 160 to second barrier 10B. In this configuration, each of barriers 10A and 10B are connected together. As barriers 10A and 10B are filled with ballast, sidewalls 40 and 42 outwardly bow against each other. Separation of barriers 10A and 10B, however, is prevented as a result of connector 160. Specifically, legs 180 and 182 of connector 160 bias against corresponding outside walls 136 to prevent separation of barriers 10A and 10B. The use of bolts 188 can also help to prevent separation. As a result of the outward bowing of sidewalls 40 and 42, a tension is placed on connector 160 and the frictional engagement between barrier 10A and 10B is increased. These forces increase the strength of the connection between barriers 10A and 10B. In alternative embodiments, substantially the same effect can be achieved by filling one of the barriers with ballast.

The present invention also includes means for mechanically mating a pair of barriers together for transport and/or storage. As depicted in FIGS. 2 and 3, by way of example and not by limitation, projecting from back wall 50 adjacent to floor 120 is a tenon 88. In the depicted embodiment, tenon 88 comprises an outwardly projecting plug 90 that terminates at an end wall 92 and bounds an internal pocket 82. Tenon 88 is configured complementary to a mortise 94 projecting into back wall 100 adjacent to top wall 20. Mortise 94 can also function as a pocket 82 as previously discussed.

Figure 14:
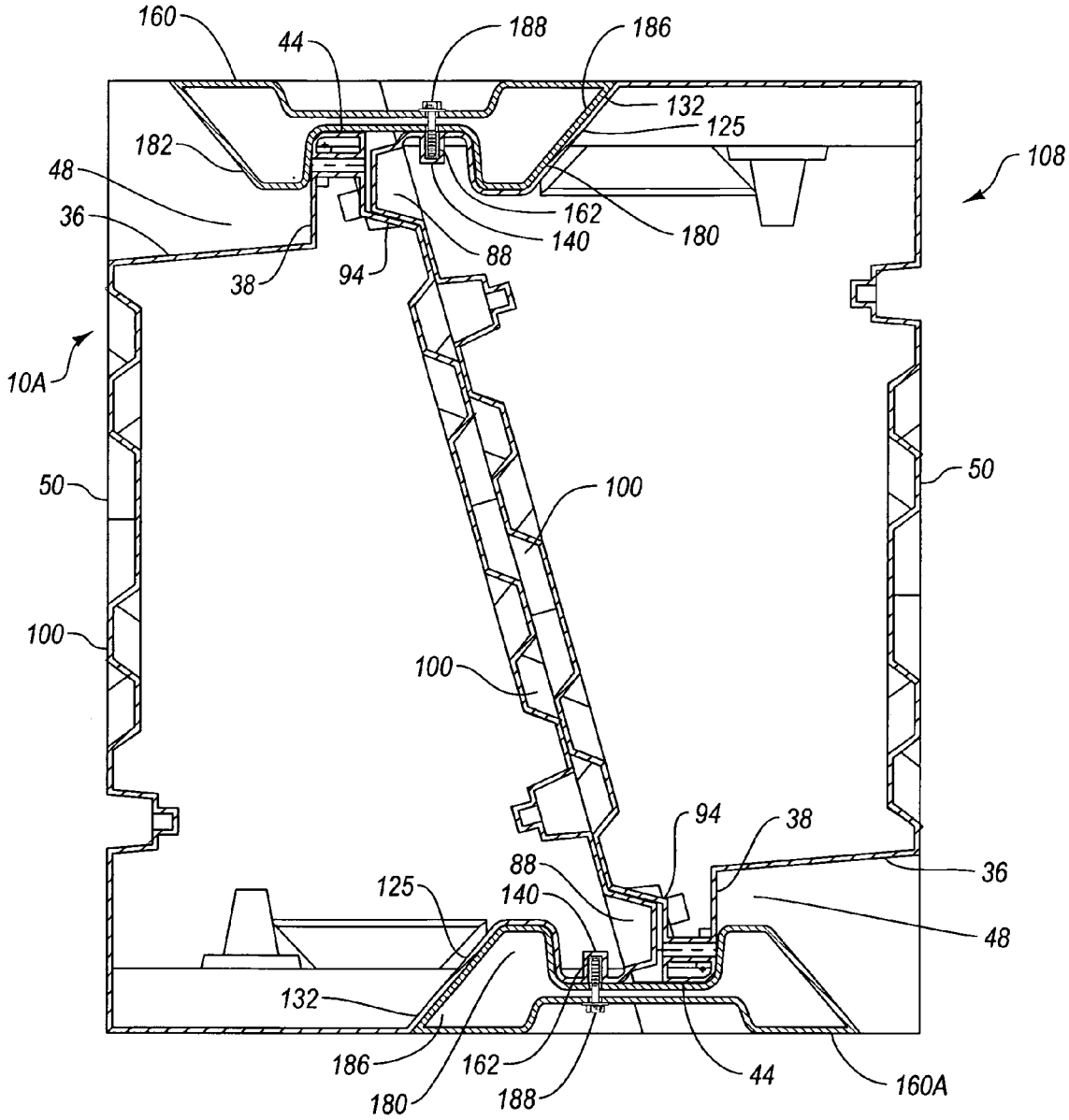
FIG. 14 is a cross-sectional side view of a pair of barriers shown in FIG. 3 coupled together for storage or transport.

As depicted in FIG. 14, by inverting a second barrier 10B and mating back walls 100 thereof together, tenon 88 of each of barriers 10A and 10B is received within the corresponding mortise 94 of the opposing barrier. As such, barriers 10A and 10B are mated together. When sidewalls 40 and 42 form a right triangle, the resulting mated barriers 10A and 10B have a substantially square or rectangular transverse cross-section. The overall mated structure has a substantially cube or parallelepiped configuration. As a result, the mated barriers 10A and 10B are easily stacked for transport or storage. In alternative embodiments, tenon 88 and mortise 94 can be a variety of alternative configurations and need only be constructed so that they mate together. Similar mortise and tenon configurations can also be formed on front wall 50 of barrier 10 for connecting adjacent front walls of barriers 10 together.

To more securely attach stacked barriers 10A and 10B together, connectors can be used. In one embodiment, connectors 160, which are used to attach barriers 10 together in consecutive order as described above with regard to FIG. 13, can also be used to attach the stacked or mated barriers as depicted in FIG. 14. This common use of connectors saves cost since connectors 160 will already be on hand.

As depicted in FIG. 14, once barriers 10A and 10B are mated together, first leg 180 of connector 160 is received within slot 125 located on floor 120 of barrier 10A adjacent to front wall 50. Inside wall 132 of slot 125 of barrier 10A and outside face 186 of connector 160 are complementarily configured so that leg 180 is self seating within slot 125. As depicted, simultaneously with first leg 180 of connector 160 being received within slot 125 of barrier 10A, cross member 164 of connector 160 is received within notch 44 of partition wall 38 and second leg 182 of connector 160 is received within recess 48 located on top wall 20 of barrier 10B. Inside face 184 of leg 182 butts up against or is disposed adjacent to partition wall 38 of recess 48 so as to prevent unwanted separation between barriers 10A and 10B. A bolt 188 or other fastener can then be used to mechanically secure connector 160 to barrier 10A by passing through connector 160 and threading into insert 140. In like manner, a second connector 160A can be secured within slot 125 on the floor of barrier 10A and within recess 48 of barrier 10B so as to further secure barriers 10A and 10B together.

Barriers 10A and 10B and connectors 160 are configured so that when assembled as depicted in FIG. 14, the bottom surface of connectors 160 are substantially flush with the corresponding top surface and bottom surface of the barriers. As a result, the top surface and bottom surface of the assembled barriers are substantially flat. This enables groups of assembled barriers to be easily and compactly stacked on top of and adjacent to one another for efficient storage and transport If desired, a tie down port, such as is described in the '285 patent, can be used to enable structures to be tied to barrier 10 by passing a rope, strap or other type of cord through the tie-down port. As also described in the '285 patent, to minimize the potential for barrier 10 to be tipped over, such as in crowded events, a plate can be attached thereto. More information about using a tie-down port or plate can be found in the '285 patent.

As mentioned above, fork lift channels 122 can extend through either or both front wall 50 and back wall 100 and along floor 120. In some embodiments, as depicted in FIG. 1, fork lift channel 46 are also included which extend through either or both front wall 50 and back wall 100 along top wall 20. Fork lift channels 46 are vertically aligned with fork lift channels 122. Specifically, fork lift channels 46 are positioned on barrier 10 such that when first barrier 10A is inverted and seated against second barrier 10B for transport or storage as described above with regard to FIG. 14, fork lift channel 46 of the first barrier 10A are longitudinally aligned with fork lift channel 122 of the second barrier 10B. This allows the tines of a fork lift to pass through both sets of fork lift apertures 122 and 46 and thus allows the fork lift to easily lift and move the mated barriers 10A and 10B. Furthermore, because fork lift channels 122 and 46 are aligned on both the bottom and top of the assembled barriers and extend all the way through the assembled barriers, the assembled barriers can be flipped or rotated and still provide fork lift holes for movement of the assembled barriers.

As mentioned above, additional features which can be incorporated into the present invention are disclosed in the '285 patent.

Many advantages are realized by the different embodiments and features disclosed herein. Using slots and retention channels disclosed herein provides increased structural rigidity to the front and back walls. It also allows many different types of displays, poles, supports and other features to be easily attached to the barrier, thereby providing enhanced use and greater versatility to the barrier.

The use of connectors to secure barriers together when the barriers are mated for storage or transport ensures that the barriers stay mated. This makes it easier for the barriers to be moved, handled, and stacked without become disconnected. Furthermore, because the connectors have a second use for connecting the barriers linearly, it avoids the need of having to make disposable connectors. Likewise, the present system eliminates the need to wrapping the stacked barriers in disposable plastic sheets which is both wasteful and environmentally unfriendly.

Furthermore, providing fork lift channels on the top and bottom surfaces of the barrier which are aligned when the barriers are mated, greatly facilitates moving and stacking the barriers, especially during transport and storage.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A barrier comprising:

a housing having a front wall and an opposing back wall, the housing also including an interior surface bounding an interior chamber, the housing being comprised of a polymeric material;

an elongated first slot recessed within the front wall;

an elongated first retention channel secured within the first slot, the first retention channel having a substantially C-shaped transverse cross section formed by:

a back wall having a top end and a bottom end;

a top wall extending away from the top end of the back wall; and a bottom wall extending away from the bottom end of the back wall, the top and bottom walls each including a lip extending therefrom, the lips extending toward each other; and means for filling the interior chamber with a ballast, wherein said first retention channel is configured to receive a fastener for attaching a display to said barrier.

2. The barrier of claim 1 wherein the elongated first slot is horizontally disposed.

3. The barrier of claim 1, further comprising:

an elongated second slot recessed within the front wall, the second slot being spaced apart from the first slot; and an elongated second retention channel secured within the second slot, the second retention channel having a substantially C-shaped transverse cross section wherein said second retention channel is configured to receive a fastener for attaching a display to said barrier.

4. The barrier of claim 1 further comprising a display removably attached to the first retention channel.

5. The barrier of claim 1, further comprising:

an elongated third slot recessed within the back wall; and an elongated third retention channel secured within the third slot, the third retention channel having a substantially C-shaped transverse cross section that is configured to receive a fastener for attaching a display to said barrier.

6. An interlocking barrier system comprising:

a first barrier comprising a front wall and a back wall each extending between a top wall and a floor, at least a portion of the front wall being sloped relative to the back wall, the first barrier also having at least one retention channel capable of removably supporting a display, and an interior surface bounding an interior chamber;

a second barrier comprising a front wall and a back wall each extending between a top wall and a floor, at least a portion of the front wall being sloped relative to the back wall, the second barrier also having at least one retention channel capable of removably supporting a display, and an interior surface bounding an interior chamber, the second barrier being inverted relative to the first barrier with the front wall of the second barrier seated against the front wall of the first barrier; and a first connector removably secured to the first barrier and to the second barrier so as to secure the first barrier to the second barrier in said inverted configuration in said inverted configuration.

7. The barrier system of claim 6, wherein the first connector has a substantially U-shaped configuration.

8. The barrier system of claim 7, wherein the first connector extends over a portion of the top wall of the first barrier and extends over a portion of the floor of the second barrier.

9. The barrier system of claim 8, further comprising a fastener extending through the first connector and removably engaging the first barrier or the second barrier.

10. The barrier system of claim 7, wherein a first portion of the first connector is received within a recess formed on the top wall of the first barrier and a second portion of the first connector is received within a slot formed on the floor of the second barrier.

11. The barrier system of claim 8, further comprising a second connector removably secured to the first barrier or the second barrier so as to secure the first barrier to the second barrier.

12. The barrier system of claim 11, wherein the second connector extends under a portion of the floor of the first barrier and extends under a portion of the top wall of the second barrier.

13. The barrier system of claim 11, wherein the second connector has a substantially U-shaped configuration.

14. The barrier system of claim 6, wherein the front wall, the back wall and the floor of the first barrier each extend between opposing side walls, a slot being formed on the floor and extending through one of the side walls, the first connector being configured to be removably received within the slot.

15. The barrier system of claim 14, wherein each of the opposing sidewalls of the first barrier has a substantially trapezoidal configuration.

16. The barrier system of claim 6, further comprising:

a pair of spaced apart first fork lift channels recessed on the floor of the first barrier and extending between the front wall and the opposing back wall of the first barrier; and a pair of spaced apart second fork lift channels recessed on the top wall of the second barrier and extending between the front wall and the opposing back wall of the second barrier, the first fork lift channels and the second fork lift channels being aligned so that the tines of a fork lift can simultaneously be received within the first fork lift channels and the second fork lift channels.

17. A barrier comprising:

a housing having a front wall and an opposing back wall each extending between a top wall and an opposing floor, at least a portion of the front wall being sloped relative to the back wall, the housing also including an interior surface bounding an interior chamber at least one retention channel is secured to the housing, the retention channel being capable of supporting signage, in a variety of positions along said housing;

a pair of spaced apart first fork lift channels recessed on the floor of the housing and extending between the front wall and the opposing back wall; and a pair of spaced apart second fork lift channels recessed on the top wall of the housing and extending between the front wall and the opposing back wall.

18. The barrier as recited in claim 17, wherein the first fork lift channels are vertically aligned with the second fork lift channels.

19. The barrier as recited in claim 17, wherein the housing also includes an interior surface bounding an interior chamber, the housing being comprised of a polymeric material.

20. The barrier as recited in claim 19, further comprising means for filling the interior chamber with a ballast.

21. A barrier comprising:

a housing having a front face and an opposing back face each extending between a top wall and a floor, the housing also including an interior surface bounding an interior chamber, the housing being comprised of a polymeric material at least one retention channel is secured to the housing, the retention channel being capable of supporting signage, in a variety of positions along said housing;

a recess formed on the top wall with a partition wall being formed between the recess and the back face, an opening extending through the partition wall so as to communicate with the recess, the recess extending through the front face of the housing;

a light removably disposed within the recess;

a fastener extending through the opening on the partition wall and removably engaging the light; and means for filling the interior chamber with a ballast.

* * * * *

UNITED STATES PATENT AND TRADEMARK OFFICE

CERTIFICATE OF CORRECTION

PATENT NO. : 7,275,888 B1
APPLICATION NO. : 11/333887
DATED : October 2, 2007
INVENTOR(S) : Christensen et al.

It is certified that error appears in the above-identified patent and that said Letters Patent is hereby corrected as shown below:

The title page showing the illustrative figure should be deleted to be replaced with the attached title page.

The drawing sheets, consisting of Figs. 5 and 14, should be deleted to be replaced with the drawing sheets, consisting of Figs. 5 and 14, as shown on the attached page.

(12) United States Patent
Christensen et al.

(10) Patent No.: US 7,275,888 B1
(45) Date of Patent: Oct. 2, 2007

(54) INTERLOCKING BARRIERS

(75) Inventors: Marc E. Christensen, Salt Lake City, UT (US); Eric M. Simon, Salt Lake City, UT (US); William L. Snook, West Chester, PA (US)

(73) Assignee: Off the Wall Products, LLC, Salt Lake City, UT (US)

( * ) Notice: Subject to any disclaimer, the term of this patent is extended or adjusted under 35 U.S.C. 154(b) by 0 days.

(21) Appl. No.: 11/333,887

(22) Filed: Jan. 18, 2006

Related U.S. Application Data

(60) Provisional application No. 60/663,090, filed on Mar. 18, 2005.

(51) Int. Cl.

| | |
|---|---|
| ***E01F 9/00*** | (2006.01) |
| ***E01F 13/00*** | (2006.01) |
| ***E01F 13/02*** | (2006.01) |
| ***E01F 9/016*** | (2006.01) |
| *E01F 15/02* | (2006.01) |
| *E01F 15/10* | (2006.01) |

(52) U.S. Cl. ..... 404/6

(58) Field of Classification Search ..... 404/6, 404/9; 256/13.1

See application file for complete search history.

(56) References Cited

U.S. PATENT DOCUMENTS

| | | | | |
|---|---|---|---|---|
| 2,146,113 | A * | 2/1939 | Erickson | 40/607.14 |
| 2,262,873 | A * | 11/1941 | Wise | 40/607.12 |
| 4,681,302 | A | 7/1987 | Thompson | |
| 4,772,155 | A * | 9/1988 | Dinitz | 404/7 |
| 4,773,629 | A | 9/1988 | Yodock | |
| 4,869,617 | A | 9/1989 | Chiado | |
| 5,011,325 | A | 4/1991 | Antonioli | |
| 5,123,773 | A | 6/1992 | Yodock | |
| 5,197,601 | A * | 3/1993 | Sterett | 206/511 |
| 5,208,585 | A * | 5/1993 | Sprague | 340/908.1 |
| 5,387,049 | A * | 2/1995 | Duckett | 404/6 |
| 5,452,963 | A | 9/1995 | Christensen | |
| 5,498,101 | A | 3/1996 | Braverman | |
| 5,531,540 | A | 7/1996 | Wassersurom et al. | |

(Continued)

FOREIGN PATENT DOCUMENTS

| | | |
|---|---|---|
| AU | B-50241/93 | 11/1995 |

(Continued)

OTHER PUBLICATIONS

Dexterity Design, MB-2 Modifications for Light Receiver, 2 pages, Dec. 2001.

*Primary Examiner*—Raymond Addie
(74) *Attorney, Agent, or Firm*—Workman Nydegger

(57) ABSTRACT

A stackable interlocking barrier system includes a first barrier having a front wall and a back wall each extending between a top wall and a floor, at least a portion of the front wall being sloped relative to the back wall. A second barrier also has a front wall and a back wall each extending between a top wall and a floor, at least a portion of the front wall being sloped relative to the back wall. The second barrier is inverted relative to the first barrier with the front wall of the second barrier seated against the front wall of the first barrier. A first connector is removably mounted on the first barrier and the second barrier so as to secure the first barrier to the second barrier.

21 Claims, 8 Drawing Sheets

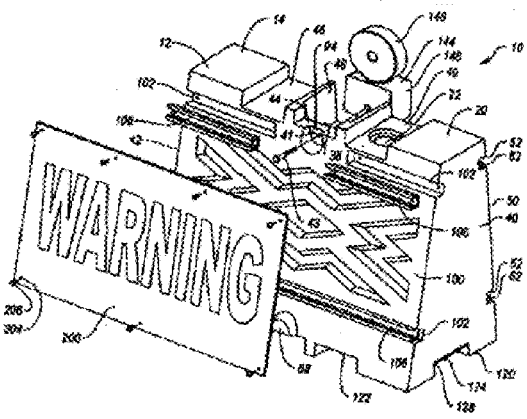

UNITED STATES PATENT AND TRADEMARK OFFICE

CERTIFICATE OF CORRECTION

PATENT NO. : 7,275,888 B1 
APPLICATION NO. : 11/333887
DATED : October 2, 2007
INVENTOR(S) : Christensen et al.

It is certified that error appears in the above-identified patent and that said Letters Patent is hereby corrected as shown below:

Drawings

Sheet 3, replace Fig. 5 with the figure depicted herein below, wherein bolts "204" have been changed to --206-- and wherein apertures "206" have been changed to --204--

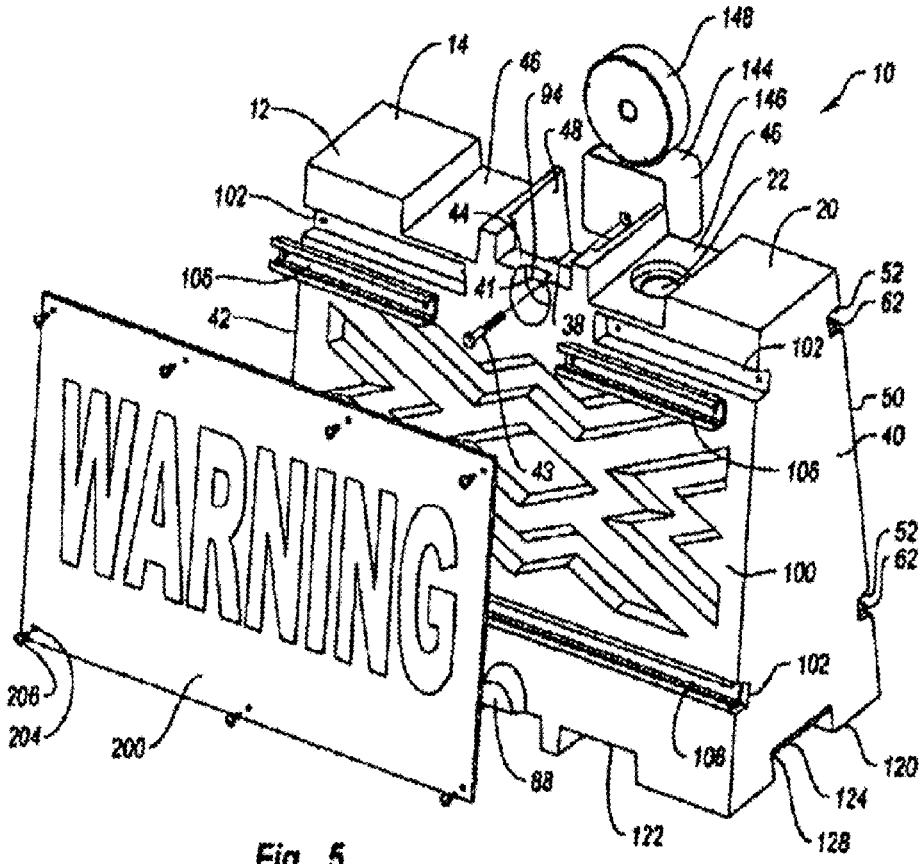

Fig. 5

UNITED STATES PATENT AND TRADEMARK OFFICE

CERTIFICATE OF CORRECTION

PATENT NO. : 7,275,888 B1 
APPLICATION NO. : 11/333887
DATED : October 2, 2007
INVENTOR(S) : Christensen et al.

It is certified that error appears in the above-identified patent and that said Letters Patent is hereby corrected as shown below:

Sheet 8, replace Fig. 14 with the figure depicted herein below, wherein connector "160" has been changed to --160A-- and connector "160A" has been changed to --160-- and also barrier "108" has been changed to --10B--

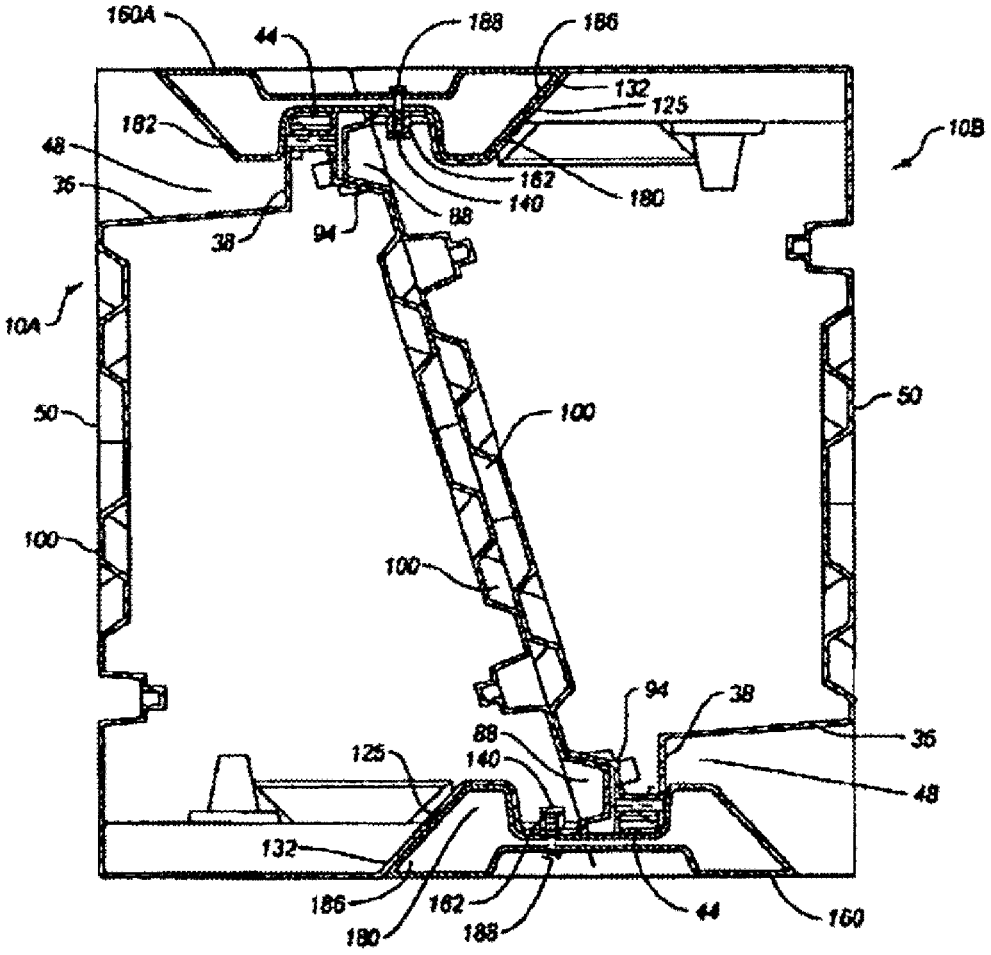

*Fig. 14*

UNITED STATES PATENT AND TRADEMARK OFFICE

CERTIFICATE OF CORRECTION

PATENT NO. : 7,275,888 B1
APPLICATION NO. : 11/333887
DATED : October 2, 2007
INVENTOR(S) : Christensen et al.

It is certified that error appears in the above-identified patent and that said Letters Patent is hereby corrected as shown below:

Column 3
Line 3, change "then" to --than--
Line 48, change "46" to --146--

Column 9
Line 2, change "10A and within recess 48 of barrier 10B" to --10B and within recess of barrier 10A--

Column 10
Lines 66-67, change "configuration in said inverted configuration." to --configuration.--

Signed and Sealed this

Eighth Day of July, 2008

JON W. DUDAS
*Director of the United States Patent and Trademark Office*